US006352357B1

(12) United States Patent
Woolard

(10) Patent No.: US 6,352,357 B1
(45) Date of Patent: Mar. 5, 2002

(54) ILLUMINATION METHOD AND DEVICE

(76) Inventor: Leslie Adrian Alfred Woolard, 16 Southborough Road, Chelmsford, Essex CM2 0AQ (GB)

( * ) Notice: Subject to any disclaimer, the term of this patent is extended or adjusted under 35 U.S.C. 154(b) by 0 days.

(21) Appl. No.: 09/445,078

(22) PCT Filed: Jun. 3, 1998

(86) PCT No.: PCT/GB98/01469

§ 371 Date: Mar. 7, 2000

§ 102(e) Date: Mar. 7, 2000

(87) PCT Pub. No.: WO98/55797

PCT Pub. Date: Dec. 10, 1998

(30) Foreign Application Priority Data

Jun. 3, 1997 (GB) ..... 97-11337

(51) Int. Cl.[7] ..... F21V 21/29

(52) U.S. Cl. ..... 362/277; 362/322

(58) Field of Search ..... 362/277, 319, 362/286, 293–322, 35, 259, 283, 324; 33/290; 359/872, 216, 217, 218, 219

(56) References Cited

U.S. PATENT DOCUMENTS

| | | | | |
|---|---|---|---|---|
| 3,865,790 A | | 2/1975 | Du Shane | 240/49 |
| 4,054,791 A | * | 10/1977 | Du Shane | 362/35 |
| 4,153,926 A | | 5/1979 | Hurt | 362/35 |
| 4,400,765 A | * | 8/1983 | Kochem | 362/277 |
| 5,408,389 A | | 4/1995 | Burlingame | 362/35 |
| 5,991,008 A | * | 11/1999 | Li et al. | 355/66 |

FOREIGN PATENT DOCUMENTS

| | | | |
|---|---|---|---|
| EP | 0 291 475 A2 | 11/1988 | F21M/3/24 |
| EP | 0 468 822 A2 | 1/1992 | F21Q/3/02 |
| GB | 0 488 616 | 7/1938 | |
| GB | 0 520 079 | 4/1940 | |
| GB | 0 558 828 | 1/1944 | |
| GB | 0 694 357 | 7/1953 | |
| GB | 0 951 604 | 3/1964 | |
| GB | 1 083 492 | 9/1967 | |
| GB | 1 486 406 | 9/1977 | F21P/5/02 |
| GB | 2 075 653 | 11/1981 | B60Q/1/06 |
| GB | 2 307 736 A | 6/1997 | F21P/1/00 |

* cited by examiner

*Primary Examiner*—Sandra O'Shea
*Assistant Examiner*—Bao Truong
(74) *Attorney, Agent, or Firm*—Synnestvedt & Lechner LLP

(57) ABSTRACT

A method for furnishing a perceptor with apparently continuous illumination over an extended target area, in which at any instant only part of said area is illuminated, but every part thereof is intermittently and repeatedly illuminated by discontinuous flashes. With regard to any one part of said target area, the flashes are repeated at time intervals not less than the decay period of the response elicited in the perceptor.

The method is performed by means of a device which comprises a beam-generating arrangement (1) that focuses a beam of radiation (5) upon a rotatably-mounted light-deflector (6), which is rotated under control at a suitably high speed by mechanical means (9, 10, 11 and 12) so as repeatedly to illuminate a target area (15) with a narrow flash to radiation (16).

10 Claims, 4 Drawing Sheets

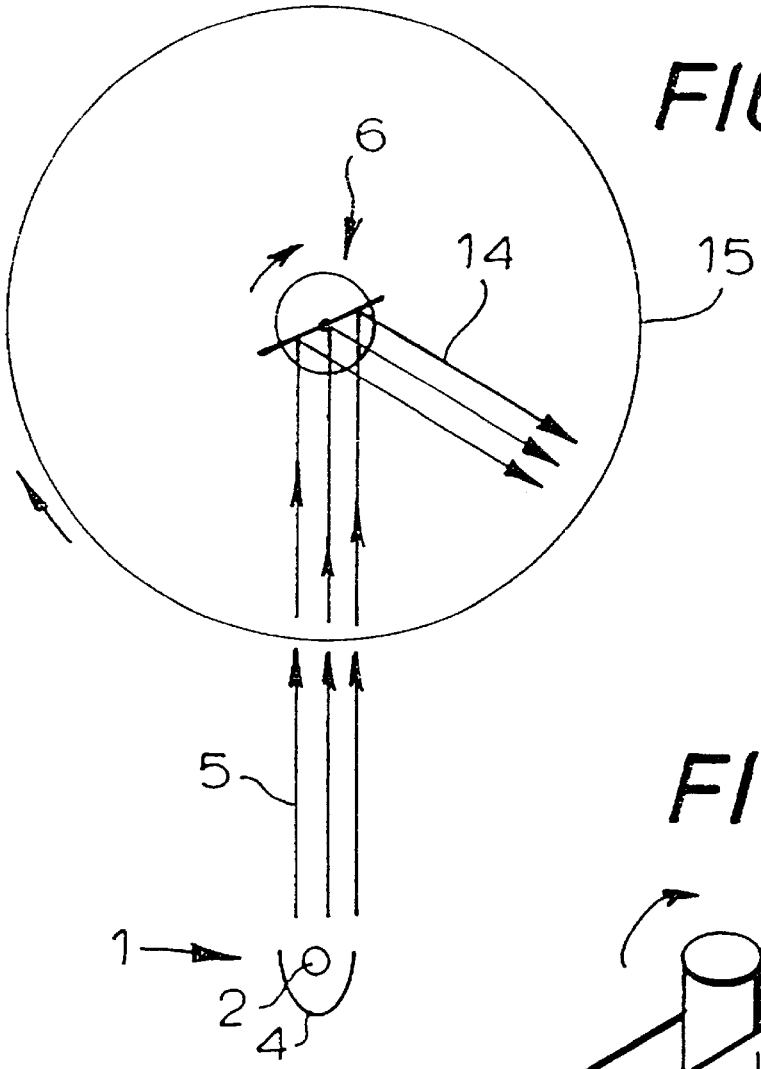
FIG.3
FIG.4
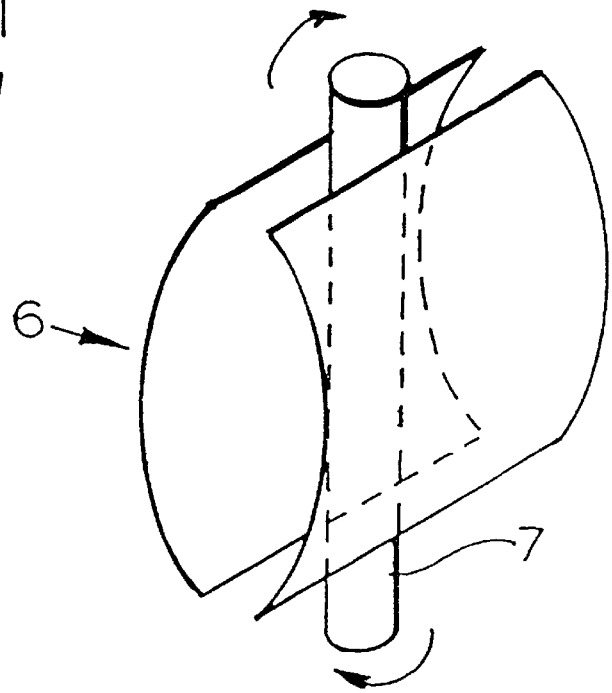

FIG.5
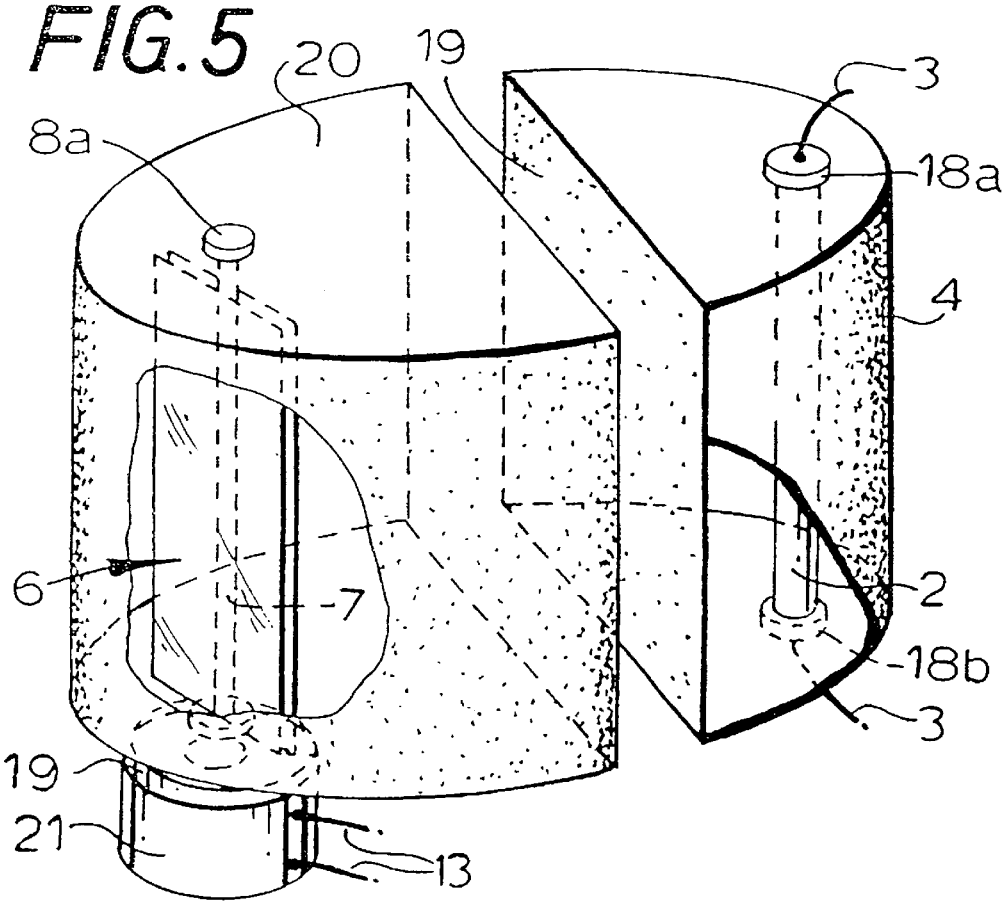
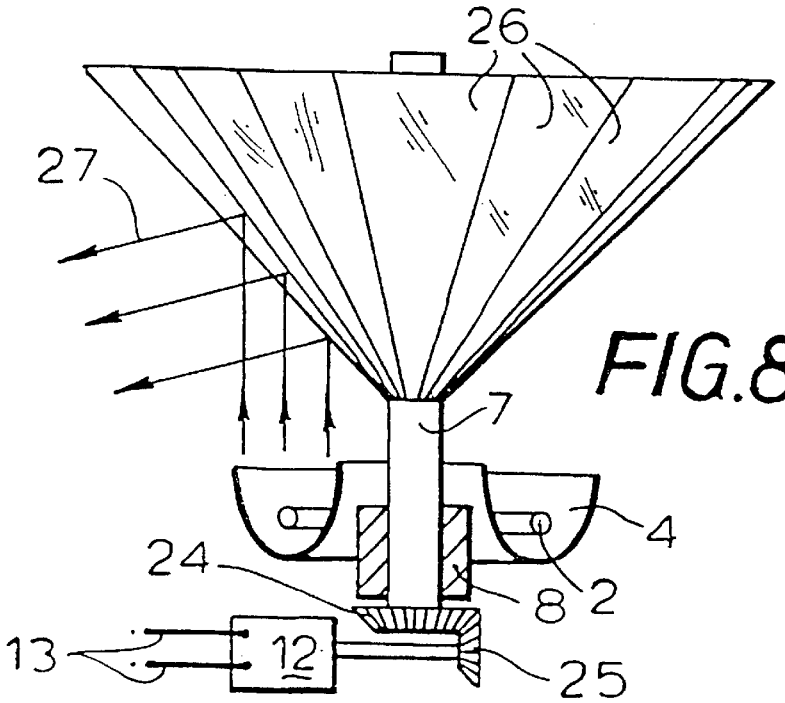
FIG.8

FIG.6
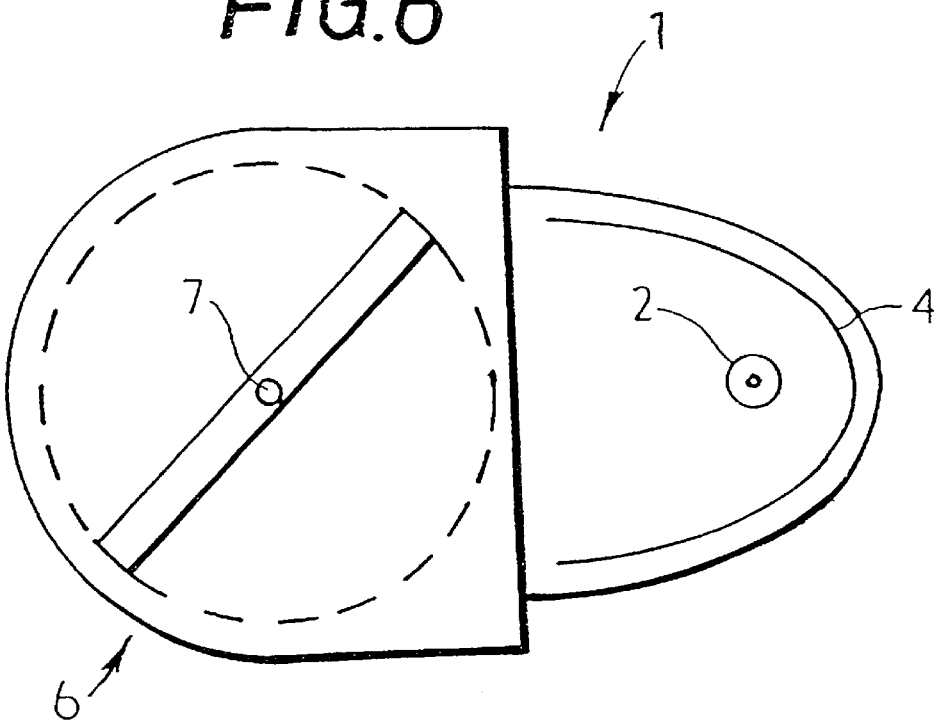
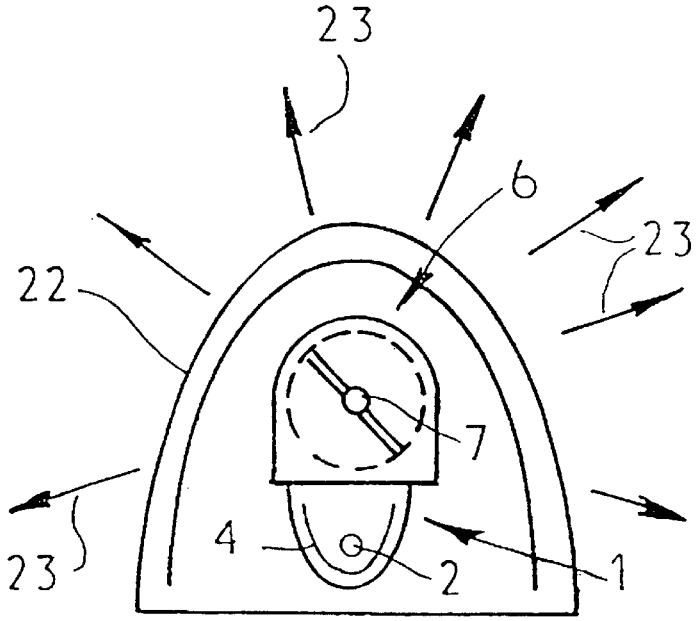
FIG.7

ILLUMINATION METHOD AND DEVICE

This invention concerns an illumination method and device.

Broadly-speaking the invention relates to a method whereby bright illumination provided by a concentrated, narrow beam of light or other electromagnetic radiation can apparently be disseminated, with comparable intensity, over a much wider area. The invention moreover also concerns a light disseminator device which is a combination of light deflector(s) with other means and which is able, in co-operation with a light source, to provide relatively high-intensity apparent illumination over a widespread target area, that is to say wide-arc illumination apparently more intense than could be spread over the same target area by the light source unaided by the device.

It is a commonplace that light emanating from a light source will normally be radiated therefrom broadcast in all directions, with correspondingly low intensity in any one direction. It is however also one of the most basic achievements of optics that light emanating from such a light source can be concentrated and directed by means of a suitable reflector (thus a mirror or system of mirrors) and/or refractor (thus a lens or system of lenses) into a narrow beam, which casts illumination of relatively much greater intensity in a chosen direction than would otherwise have been broadcast in that direction—but of course at the expense of diminishing or denying illumination in other directions. It seems that one is faced with an apparently inescapable choice—between relatively low-intensity illumination over a wide area on the one hand, or relatively high-intensity illumination over a narrow area on the other. And this is indeed the inescapable choice, when the intensity of illumination is perceived entirely objectively—there is no avoiding the laws of science, and one does not get something for nothing.

It is known, however, that the perceived intensity of illumination is in certain circumstances not objective but can be quite subjective. This phenomenon is called persistence of vision, and refers to how the human eye can be fooled into perceiving continuous illumination even if it is in fact discontinuous, i.e. rapidly repeated flashes of illumination. Therefore it is possible to produce in the eye of an human (or animal) perceptor an illusion of wide-arc, relatively high-intensity apparent illumination if a narrow, concentrated beam of such relatively high-intensity illumination is intermittently but repeatedly swept at sufficiently high frequency across a wide target area.

Various methods of overcoming the objective problem, which utilise this phenomenon, have been suggested, and the most pertinent of these have been outlined below.

U.S. Pat. Nos. 3,865,790 and 4,153,926 disclose methods and devices which have tried, with only partial success, to solve the problem by taking a device that produces a beam of light, and then rotating the entire assembly at high speed. Similarly British Patents No. 694,357 and No. 1,083,492 both also relate to devices where the light source and the beam concentrating means are rotated together.

Whilst fine in concept, this type of device is rather lacking in practical feasibility. For a start the beam produced tends to be a disc in overall configuration and this is not by any means ideal. The source will only cast light on a given point once (per beam that is produced) per revolution of the source. More importantly however, in devices of this general type, the light source can be one of relatively high power and therefore produce several beams, or it may be confined to producing one beam only and therefor require a less powerful source of light. Naturally when more beams than one are produced, and are able to scan across the target area, then the speed of rotation of the source can be reduced, but even so it will still be required to rotate at high speed. One is faced with the dilemma that if the amount of beams produced is increased, then the speed of rotation can be decreased but the size of the device that must be rotated is increased—whereas conversely the opposite of course is true in that the size of device can be kept down by using fewer beams, but then the speed at which the device must spin is dramatically increased.

These considerations mean that any design of this type must be fairly cumbersome to contain all the features required to rotate a large and complex object at high speed. For instance it requires fairly complex, and hence unreliable, wiring mechanisms to electrically link the rotating bulb to the power supply. Additionally the whole rotating part must be carefully balanced to prevent vibration and the problems associated with it.

The most important point is however that, during high speed rotation, the filament of the bulb can be forced out of alignment with the optics, due to the centrifugal forces. This is hard to avoid because a filament must by design be of narrow diameter and hence flexible.

In an attempt to overcome some of the problems associated with the above disclosed methods, devices wherein the light source was held stationary and the beam producing means were rotatable therearound were instead proposed. In British Patent No. 488,616 a device with lens arrays rotating about a light source was disclosed. Additionally in British Patent No. 520,079 a fixed light source with a set of rotating parabolic mirrors located around it was proposed. Both these devices suffer from the problem of having to rotate the beam means around the light source at high speed, but in close proximity to the bulb. This is especially a problem of the device of GB 520,079 which had at least two back-less parabolic reflectors joined around the light such that they projected at least two beams of light from the source. This has the effect of producing a weak source of light so that the overall lighting phenomenon is diminished.

Various other methods have been employed in an attempt to achieve the proposed objectives, and they have for example, involved a large rotating tower with complex internal reflectors as in GB 558,828; or they have used vibrating mirrors, light source and rotating prisms to scan light over a small area as in GB 951,604.

All the above have failed to effectively overcome the problems associated with attempting to achieve the objectives of the present invention, or indeed for that matter the objectives they set themselves. Indeed the very fact that none of them ever caught on, gives testament to their lack of effectiveness. The present invention, on the other hand, provides a convenient and effective means of achieving those objectives and overcoming the problems.

Therefore, according to this invention in its broadest aspect, there is provided a method of furnishing a perceptor with apparently-continuous illumination by electromagnetic radiation to which the perceptor is responsive over an extended target area, in which a rotatable reflector is used to deflect a relatively narrow beam of radiation from one point to another over a relatively wide target area, whereby at any instant only part of said area is illuminated with said radiation but every part thereof is intermittently and repeatedly illuminated by discontinuous flashes of said radiation, said flashes being as regards any one part of said target area repeated at time intervals not less than the decay-period of the response of the perceptor to that radiation.

The terms "radiation" and "reflector" used above, and hereinafter employed for convenience, refer respectively to any suitable electromagnetic radiation that may be efficiently reflected, and to a reflector capable of reflecting said radiation.

It is currently envisaged that the electromagnetic radiation employed will be in the ultraviolet, visible and/or infrared ranges, thus corresponding to wavelengths of say from 1 nm up to about 5 nm. For the purposes at present contemplated it will be preferable to use visible light with wavelengths in the range of from about 380 nm up to about 780 nm, and/or actinic radiation i.e. light in the violet and ultra-violet regions of the spectrum which will bring about chemical or photochemical changes, and may be regarded as corresponding to wavelengths of from 4 to 600 nm. Of course the term "ultra-violet (or UV) radiation" refers to the non-visible part of actinic radiation, and may be regarded as corresponding to wavelengths of from 4 to 400 nm., and more especially 325–365 nm. Thus overall the preferred visible and actinic radiation for use in the method of the invention corresponds to wavelengths in the range of from 4 nm up to 780 nm. The electromagnetic radiation employed may be coherent, subject to the normal considerations governing its generation and use; but as currently envisaged will usually be normal, incoherent radiation.

Where the context so allows, the term "perceptor" as used herein includes not only the human (or other animal) eye responsive in the visible light range but also non-animal (e.g. electric and/or electronic) perceptor instruments responsive in the visible and/or the non-visible radiation ranges. It moreover also includes part-human (or other animal) and part-instrumental perceptors, as for instance when non-visible radiation is perceived initially by an instrument responsive thereto but then converted within that instrument into a secondary image in the visible light range and thus perceptible by the human (or other animal) eye of an ultimate observer.

The decay of the response of any perceptor will generally be exponential, and of course the term "decay-period" is not here used in an extreme theoretical sense which could include almost infinite periods as the response approaches zero but in its practical sense which embraces only perceptor-responses that are useful for their intended purpose. On an admittedly arbitrary basis the outside limit of the relevant decay-period can be defined as that over which the response of the perceptor falls to 30% of the maximum response of the perceptor to stimulation by that radiation. For all currently-envisaged purposes the decay-period should be set at that during which the perceptor-response falls to no less than 50% of maximum, and it is believed that the best results will be achieved when the relevant decay-period is set to end at a level of 80% or even 90% of maximum response.

In order to reduce or avoid any sensation in the perceptor of flickering in the perceived illumination it is quite desirable that the flashes of illumination should be repeated as regards any one part of the target area at least twice during the decay period, and (within experience so far) it is best if they are repeated substantially three times during that period. When the illumination is in the visible range and the intended perceptor is the human eye these preferences correspond roughly with the flashes of visible light being desirably repeated at least twice every one-tenth of one second, and best repeated substantially three times every one-tenth of one second.

According to another preferred aspect of this invention there is also provided a light disseminator, for use in carrying out the method herein disclosed, which comprises means operable to direct a beam of light so that it impinges upon a rotatably-mounted light-deflector, said light-deflector being arranged and disposed so that dependent upon its rotational position it will deflect the light-beam to one point or another around an arcuate target area centred upon the rotatable deflector, and means operable to rotate the light-deflector so that it sweeps the deflected beam around said arcuate target area, at a rotational rate such that any given part of the arcuate target area is intermittently but repeatedly illuminated by discontinuous flashes of light provided by the deflected light-beam at time-intervals of not more than one-tenth of one second.

In this case, the perceptor is to be the human eye, and the time-intervals should preferably be not more than one-thirtieth of one second, and possibly or even desirably still less.

Of course, the beam-directing means will desirably be so disposed and arranged as normally to direct a beam of substantially parallel light to impinge upon the rotatably-mounted mirror, but it is for some end-uses advantageous also to provide means for adjusting the arrangement out of its normal disposition so as either to converge or to diverge the otherwise substantially parallel light-beam.

The beam-directing means preferably will comprise means for mounting a light-source, and a concave reflector mounted adjacent to said light-source on its side remote from the light-deflector so as to assist in directing the desired parallel light-beam to impinge upon the light-deflector(s).

Alternatively or in addition the beam-directing means may comprise means for mounting a light-source, and a convex lens or lens system mounted between said light-source and the light-deflector so as to assist in directing the desired parallel light-beam to impinge upon the light-deflector(s).

The light-disseminator will normally include an electrically-operable incandescent light-source supported in the mounting means, and there provided with electrical connections adapted under control to operate the incandescent light-source. The light-source advantageously is or includes a single-filament incandescent light bulb so supported in the mounting as to dispose the filament with its axis normally vertical.

The light-deflector may be a refractor, e.g. a multi-sided-prism, but experience so far suggests that it is advantageously a rotatably-mounted reflector, usually indeed a multi-faceted reflector. For the purposes currently envisaged the rotational axis of the light-deflector(s) should in normal use be disposed vertically.

In the simplest arrangement the multi-faceted reflector will advantageously be a double-side plane mirror. With such an arrangement, and in an ideal set-up wherein a beam of truly parallel light from a truly linear source is incident upon a plane mirror of the same depth as the beam, then the reflected beam will be neither divergent nor convergent, and thus will have the same depth as the incident beam. Therefore on rotation of the mirror the reflected beam will be swept around a substantially 360° arc, creating at any given instant a corresponding small patch of high-intensity illumination, (having the same depth as both the incident beam and the linear source) at one particular point on the 360° arc centred on the rotating mirror. In practice it is however effectively impossible to achieve such an ideal set-up, and there is an inevitable tendency for the beam incident on the mirror to include some stray, non-parallel light—and in that event the beam even when reflected from a plane mirror will to some extent be slightly divergent. Nevertheless when using a beam of parallel light and a plane mirror most of the light is concentrated in the previouslymentioned small patch, and due to persistence of vision in an human observer's retina it will be perceived as a fairly thin, flat "band" of illumination around the rotating mirror, so-to-speak in a sort of horizontal disc.

Dependent upon requirements, it is possible either to accentuate the tendency for the beam to diverge or to try to counteract it.

Thus, in order to promote a wider band of illumination the light-deflector can be so constructed and arranged that it encourages the substantially-parallel light-beam impinging thereon to become divergent in the vertical planes containing the rotational axis of the light-deflector, e.g. by making the light-deflector a slightly-convex mirror.

Conversely, if it should be wished to concentrate the illumination into a still narrower band, then the light-deflector can be so constructed and arranged that it counters any tendency for the substantially-parallel light-beams impinging thereon to become divergent, or indeed even forces it to become convergent, e.g. by making the light-reflector a slightly-concave mirror.

The transverse dimensions of the light-deflector in the plane normal to the impinging light-beam will desirably exceed the width of that light-beam, so as to ensure that the full width of the light-beam is deflected thereby for so much as possible of its rotation. On the other hand the light-deflector would have to be of infinite width if it were to be capable of deflecting the full width of the incident light beam throughout its entire rotation, which of course is absurdly impossible.

Balancing these considerations, it currently appears that for practical purposes the width of the light-deflector (normal to the incident beam, and in the plane normal to its rotational axis) should conveniently be in the range of from about 1.12 to about 2.24 times the width of that beam. On a somewhat arbitrary basis, it is currently thought best if the width of the light-deflector is substantially 1.4 times the width of the beam.

The light disseminator of this invention may be embodied in various ways according to the end-use envisaged. Possible uses seem very extensive, and have not yet been fully explored, but fall broadly into two categories. In one category of end-use the ultimate observer carries the device himself or for instance upon a vehicle, and thus requires wide-arc but still partly-directional illumination ahead of him, e.g. in the manner of a hand-held torch or a vehicle-mounted headlamp. In another category of end-use the ultimate observer wishes to set up the device to provide high intensity all-round illumination, either temporarily as for instance at the scene of an accident or other emergency or on a more permanent basis as for instance in sporting arenas or other public concourse areas.

In order that the invention may be well understood various simple embodiments thereof will now be described in more detail, though only by way of illustration, with reference to the accompanying schematic drawings (in which so far as possible the same reference numerals have been used for the same parts in all the various figures) as follows:

FIG. 3 is a diagram also in plan view which indicates how rotation of the light-deflector sweeps the deflected light beam and thus the patch of instantaneous illumination around an arc of substantially 360° centred upon the rotational axis of the light-deflector;

FIG. 4 is a diagrammatic and exaggerated representation of an alternative and sometimes desirable double-sided light deflector for use in the arrangement of FIGS. 1 to 3, which in place of plane mirrors uses semi-convex mirrors, i.e. mirrors which are convex in the vertical plane through their rotational axis but planar radially thereof;

FIG. 5 is a still-diagrammatic, partly cut-away, perspective and part-exploded view of a more practical embodiment of the basic light disseminator illustrated in FIGS. 1 to 4, intended to direct illumination over a wide but not full 360° arc, rather in the manner of a hand-held torch or car headlight;

FIG. 6 is a simplified, plan view of the embodiment of FIG. 5, with the respective light-source and spinning light-deflector compartments juxtaposed (rather than exploded) and with their transverse dimensions more realistically adjusted relative to each other;

FIG. 7 is a similar plan view of the embodiment of FIGS. 5 and 6, when mounted within a transparent housing, as they might be in an hand-held torch or, more especially, in a single car-headlight which affords wide-angle, bright, but still partly-directional illumination ahead and to each side of the observer carrying the torch or seated in the vehicle; and FIG. 8 is a side-elevation, partly in cross-section, of an alternative embodiment of combined light source and rotatable light deflector, intended to provide illumination around a full 360° arc.

Figure 1:
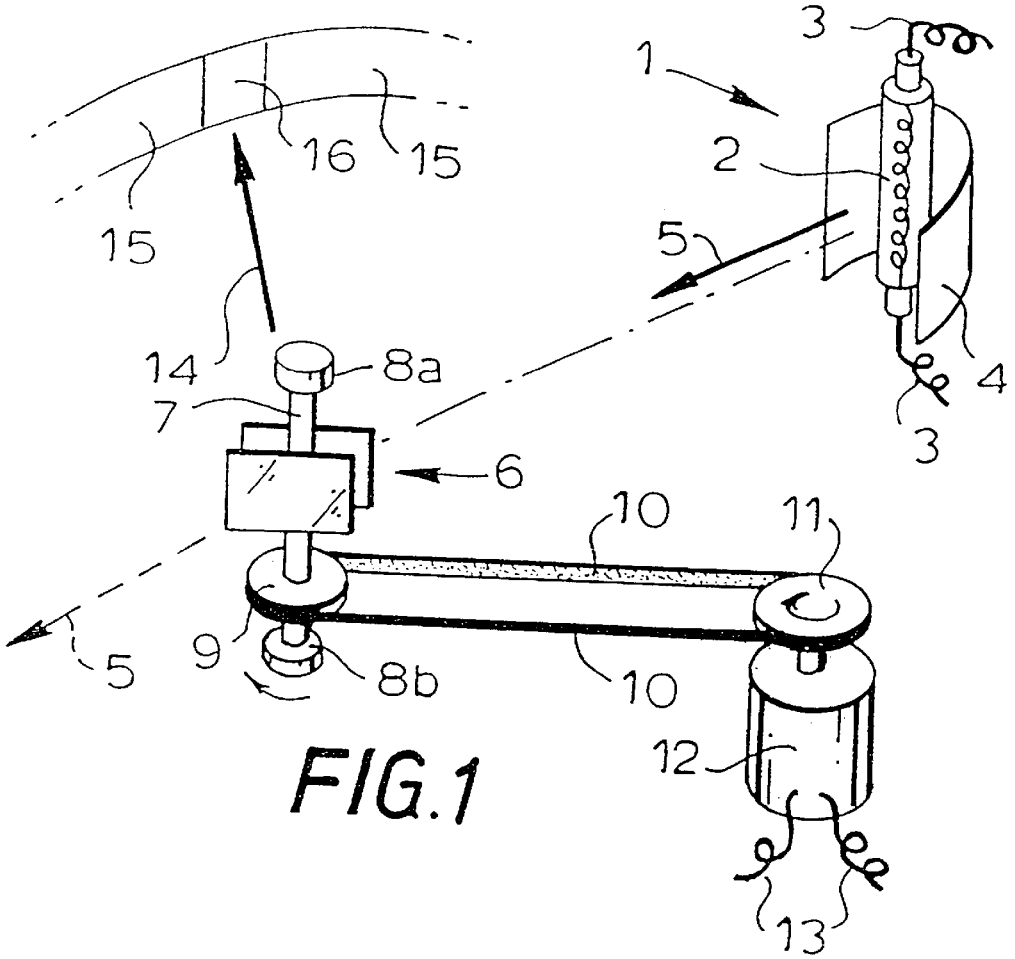
FIG. 1 is a perspective view of the basic elements of a light-disseminator arrangement in accordance with this invention, laid out diagrammatic ally in a manner intended to facilitate understanding of its principle of operation rather than as it would be actually embodied in a commercial construction.
Figure 2:
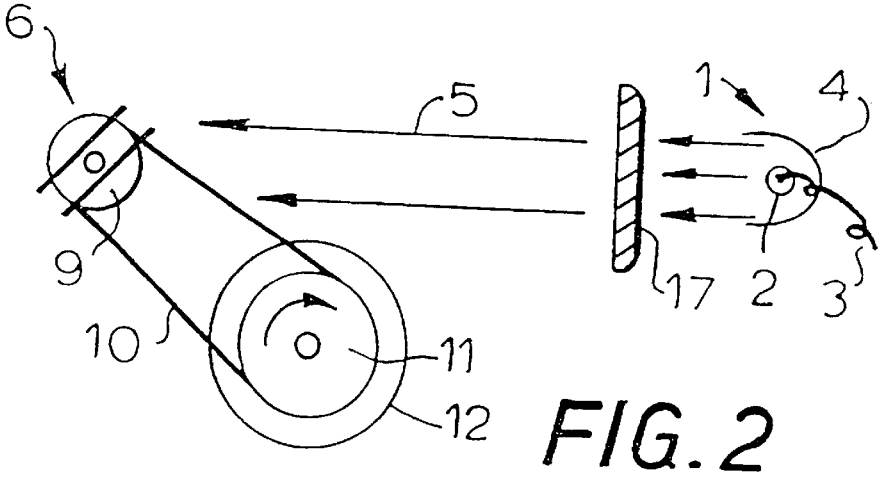
FIG. 2 is a plan view of a slightly more elaborate but basically similar arrangement to that shown in FIG. 1 mentioned above.

Referring first to the schematic lay-out illustrated in FIGS. 1 to 3, an electric light-source generally indicated 1 has a vertically-disposed, substantially linear incandescent filament 2, and is interchangeably supported in suitable fittings (not shown) and supplied with power via electric leads 3. The light-source 1 is positioned with the vertical axis of filament 2 at the focus of a semi-parabolic reflector 4, that is to say one which is parabolic in the horizontal plane but planar in all vertical planes, and directs a narrow but deep beam of substantially parallel light, approximately rectangular in cross-section, in the direction of arrow 5 onto a double-sided reflector generally-indicated 6, mounted on a rotatable, vertical spindle 7.

In the slightly more elaborate embodiment illustrated in FIG. 2, the arrangement also includes a centrally-planar but peripherally convex lens 17 positioned between the light source 1 and the rotatable light deflector 6, the convex periphery of which tends to collect stray, non-parallel light emergent from the parabolic mirror 4 and converge it into parallel beam 5.

The top and bottom ends of spindle 7 are rotatably supported in journals 8*a* and 8*b*, and the spindle 7 is provided with a driven pulley-wheel 9 interconnected by belt 10 with the drive pulley-wheel 11 of an electric motor 12 supplied with power via leads 13.

When power is connected to light-source leads 3 and motor leads 13 the light generated by the filament 2 is concentrated into a narrow beam which is directed onto the rotating double-sided mirror 6 and there deflected, e.g. in the direction of arrow 14, but as the spindle-mounted mirrors 6 are rotated the deflected beam is swept around in a substantially 360° arc, partially indicated 15.

At any given instant the beam of light 14 will illuminate only a small patch e.g. as indicated at 16, that patch being illuminated at that instant with the full intensity of which the particular arrangement is capable—but the illuminated patch will sweep around arc 15 at a rotational speed directly related to that imparted to the spindle 7 by the driven pulley-wheel 9, drive belt 10, drive pulley-wheel 11 and motor 12. When the reflector employed is double-sided (as in all of FIGS. 1 to 7) the sweep-rate will be twice the rotational speed of the spindle. The retina of the eye of the observer will perceive the patch 16 at its full illumination no matter where it finds itself, and due to persistence of vision will continue to respond to that level of illumination for about 1/10th of a second. Provided therefore that the patch 16 is re-illuminated by the rotating beam at least every 1/10th of a second the retina of the eye will perceive patch 16 as if it were steadily illuminated at the full level of which the arrangement is capable, and this no matter where the patch 16 under discussion is located around the 360° arc centred on the rotating spindle 7.

Thus by driving motor 12 at such a speed as to sweep the beam around the arc at least once every one-tenth of one second the illustrated arrangement can persuade the eye of an observer to perceive the full-level illumination of a narrow beam as if it extended all the time around the full 360° arc. With the double-sided mirror arrangement of FIGS. 1 to 3 this requires the motor 12 to rotate the spindle 7 at a rate of at least 300 revolutions per minute (rpm) in order to achieve a sweep-rate of at least 600 rpm.

FIG. 4 illustrates (in an exaggerated manner) a modification of the twin-mirror arrangement shown in FIGS. 1 to 3, in which the spindle-mounted, double-sided plane mirrors 6 there shown are here replaced by semi-convex mirrors, so that the impinging beam 5 is diverged thereby into a broader band of illumination.

Referring now to FIG. 5, this shows (still rather schematically) a more practical embodiment in which as before a vertically-disposed linear light source 2 is supported between sockets 18*a* and 18*b* in alignment with the focus of the semi-parabolic reflector 4. By means of the sockets 18*a* and 18*b* the light source is thereby connected to electric leads 3. Unlike the previously-described arrangement this light-source assembly is provided with a transparent front cover-plate 19, formed of glass or "Perspex" (Registered Trade Mark) or some similar rigid transparent material.

The double-sided planar light-deflector 6 is, as in the previous embodiment, mounted on vertical spindle 7 rotatably supported between upper journal 8*a* and a lower journal (not shown). The lower end of spindle 7 is provided with a circular metal disc 19, whose function will be explained below. The light-deflector assembly comprising double-sided mirror 6, spindle 7, journals 8*a* and 8*b* (not shown) and the metal disc 19 is however, unlike previously-described arrangements, housed within a transparent, evacuated housing 20, again formed of glass or "Perspex" (Registered Trade Mark) or some other rigid transparent plastics material.

Evacuation of the housing 20, even if less than total, reduces air-resistance to the rotation of the spindle and the double-sided mirror mounted thereon—but of course introduces difficulties in driving rotation of this light-deflector assembly 6. In this embodiment however the metal disc 19 within the housing 20 serves as the rotor member of an electrical induction motor, the stator 21 of which is mounted beneath the rotor 19 but outside the housing 20. The stator member 21 is powered via electrical leads 3. Obviously using such an induction motor solves the problem of rotating the light-deflector assembly within housing 20, but necessitates supplying alternating current (ac) via leads 3 to the stator member 21. For certain purposes (e.g. in small light-disseminators akin to a hand-held torch or lantern) the need for the use of ac is a complication which may be undesirable—but it can be solved even when the electric power supply is derived from a dc source such as a battery by interposing an inverter (not shown) between the power source and the stator member 21.

The kind of arrangement described and illustrated with reference to FIG. 5 above is basically advantageous because it enables the light-deflector assembly to be housed within an evacuated enclosure thus reducing air-resistance to the rotation of the double-sided mirror 6 and thereby reducing power consumption and/or increasing the speed of rotation of the deflected light beam. This construction moreover facilitates exchange of either the light-source assembly or the light-deflector assembly, when either of them becomes defunct and in need of replacement.

FIG. 6 shows the assemblage of the light-source and the light-deflector into an unit, the relevant dimensions being approximately correct. It will be seen that the width of the twin-mirrors is about 1:4 times the width of the beam emergent from the light-source aperture, so that when the mirrors 6 are at an angle of about 45° the full beam-width is still accommodated within the available width of the mirrors.

FIG. 7 shows the assemblage of FIG. 6 mounted with a transparent housing 22, such as might serve as a single, possibly roof-mounted headlight for a motor vehicle providing excellent illumination not only ahead of the vehicle (not shown) but also to both sides of it over a wide arc, as for instance shown by arrows 23.

A quite different embodiment of light-disseminator, specifically intended to provide all-round illumination, is shown in FIG. 8. Here the light source 2 is an annular fluorescent tube mounted at the focus of an annular parabolic mirror 4, the annular light source 2 and parabolic mirror 4 being arranged around the vertical spindle 7 supported in a journal 8 driven by bevel-gear 24 which in turn is driven by meshing bevel-gear 25 driven by electric motor 12 powered via leads 13.

The light from source 2 is directed upwardly by parabolic mirror 4 to impinge upon a multi-faceted mirror 26, each facet being disposed at a suitable angle (e.g. 45°) to the vertical. Thus the parallel light directed upwardly from light source 2 and parabolic mirror 4 is reflected by the off-vertical mirror facets 26 into approximately horizontal beams as indicated by arrows 27. Although for simplicity of illustration this is not shown in FIG. 8, it should be noted that each of the mirror facets 26 can advantageously be fluted.

It should at this point be observed that the embodiment of FIG. 8 results in creation of not just one patch of reflected light but as many different patches of reflected light as correspond to the number of facets 26 on the rotating mirror assembly.

It will be appreciated that to achieve the illusion of wide-arc high intensity illumination what is necessary is that any given part of the target to be illuminated shall be thereby repeatedly illuminated at intervals not greater than 1/10th second, and when a single reflector is rotated to sweep a single beam around a 360° arc the rate of revolution of that single reflector must therefore be at least 600 revolutions per minutes (rpm)—but the requirement relates to the frequency with which any given patch of the target area is illuminated, and is not necessarily directly dependent on the rate of revolution of the spindle. In the case of the embodiment of FIG. 8, if the multi-faceted mirror has x facets then the minimum rate of revolution of the mirror assembly needed to achieve the illusion is 600/x revolutions per minute.

What is claimed is:

1. A method of furnishing a perceptor with apparently-continuous illumination by electromagnetic radiation to which the perceptor is responsive over an extended target area, in which a rotatable double-sided reflector is used to deflect a relatively narrow beam of substantially parallel radiation incident thereon substantially normal to its axis of rotation from one point to another over a relatively wide target area, whereby at any instant only part of said area is illuminated with said radiation but every part thereof is intermittently and repeatedly illuminated by discontinuous flashes of said radiation, said flashes being as regards any one part of said target area repeated at time intervals not less than the decay-period of the response of the perceptor to that radiation.

2. A method as claimed in claim 1, in which the electromagnetic radiation employed has a wavelength in the range of from 1 nm up to 5 nm.

3. A method as claimed in claim 1, in which the flashes are repeated as regards any one part of the target area at least twice during the decay period.

4. A method as claimed in claim 1, in which normal, incoherent electromagnetic radiation is used, the radiation employed lies in the visible range with a wavelength of from 380 nm to 780 nm, the perceptor is or includes the eye of an human observer, and the flashes of visible radiation are repeated at least twice every one-tenth of a second.

5. A light disseminator which comprises means operable to direct a beam of substantially parallel light so that said light impinges upon a rotatably-mounted double-sided light-deflector substantially normal to said light-deflector's axis of rotation, said light-deflector being arranged and disposed so that dependent upon the rotational position of said light-deflector, said light-deflector will deflect the light-beam to one point or another around an arcuate target area centred upon the rotatable deflector, and means operable to rotate the light-deflector so that said light-deflector sweeps the deflected beam around said arcuate target area at such a rotational rate that any given part of the arcuate target area is intermittently but repeatedly illuminated by discontinuous flashes of light provided by the deflected light-beam at time-intervals of not more than one tenth of a second.

6. A light-disseminator as claimed in claim 5, which also comprises means for adjusting the arrangement out of its normal disposition so as either to converge or to diverge the otherwise substantially parallel light-beam.

7. A light disseminator as claimed in claim 5, in which the beam-directing means comprise a mounting for a light-source, and a concave reflector mounted adjacent to said light-source on its side remote from the light-deflector so as to assist in directing the desired normally parallel light-beam to impinge upon the light-deflector.

8. A light disseminator as claimed in claim 5, in which the beam-directing means comprise means for mounting a light-source and a convex lens or lens system mounted between said light-source and the light-deflector so as to assist in directing the desired normally parallel light-beam to impinge upon the light-deflector.

9. A light disseminator as claimed in claim 7, which includes an electrically-operable incandescent light-source supported in the mounting, said light source including a single-filament incandescent light bulb so supported in the mounting as normally to dispose the filament thereof with its axis vertical, said light-source being there provided with electrical connections adapted under control to operate said light source.

10. A light disseminator as claimed in claim 5, in which said light-deflector has a transverse dimension measured in a plane normal to said light-deflector's axis of rotation and said light-beam has a width, also measured in said plane, said transverse dimension of said light-deflector exceeding said width of said light beam in said plane by a factor in the range of from 1.12 to 2.24.

* * * * *

UNITED STATES PATENT AND TRADEMARK OFFICE

CERTIFICATE OF CORRECTION

PATENT NO. : 6,352,357 B1
DATED : March 5, 2002
INVENTOR(S) : Woolard

It is certified that error appears in the above-identified patent and that said Letters Patent is hereby corrected as shown below:

Column 9,
Line 18, change "5 nm" to -- 5 mm --

Signed and Sealed this

Fourth Day of June, 2002

*Attest:*

*Attesting Officer*

JAMES E. ROGAN
*Director of the United States Patent and Trademark Office*